US008069537B2

(12) United States Patent
Gallant

(10) Patent No.: US 8,069,537 B2
(45) Date of Patent: Dec. 6, 2011

(54) FASTENER PRODUCTS AND RELATED METHODS

(75) Inventor: Christopher M. Gallant, Nottingham, NH (US)

(73) Assignee: Velcro Industries B.V., Curacao ( * ) Notice: Subject to any disclaimer, the term of this patent is extended or adjusted under 35 U.S.C. 154(b) by 971 days.

(21) Appl. No.: 12/122,001

(22) Filed: May 16, 2008

(65) Prior Publication Data

US 2009/0282654 A1 Nov. 19, 2009

(51) Int. Cl.
*B65D 63/10* (2006.01)

(52) U.S. Cl. ..... 24/16 PB; 24/17 AP; 24/30.5 P

(58) Field of Classification Search ..... None
See application file for complete search history.

(56) References Cited

U.S. PATENT DOCUMENTS

| | | | | |
|---|---|---|---|---|
| 2,153,227 | A * | 4/1939 | Allstatter | 40/668 |
| 2,461,201 | A | 2/1949 | Ellis | |
| 3,590,442 | A | 7/1971 | Geisinger | |
| 3,766,608 | A | 10/1973 | Fay | |
| 3,780,921 | A | 12/1973 | Harp | |
| 4,150,463 | A * | 4/1979 | Brown | 24/16 PB |
| 4,183,121 | A | 1/1980 | Cousins | |
| 4,198,734 | A | 4/1980 | Brumlik | |
| 4,271,566 | A | 6/1981 | Perina | |
| 4,477,950 | A | 10/1984 | Cisek et al. | |
| 4,557,024 | A | 12/1985 | Roberts et al. | |
| 4,657,000 | A | 4/1987 | Hepburn | |
| 4,680,838 | A | 7/1987 | Astl | |
| 4,775,310 | A | 10/1988 | Fischer | |
| 4,863,127 | A | 9/1989 | Handler | |
| 4,879,854 | A | 11/1989 | Handler | |
| 4,887,338 | A | 12/1989 | Handler | |
| 4,887,339 | A | 12/1989 | Bellanger | |
| 5,005,242 | A | 4/1991 | Kennedy et al. | |
| 5,048,158 | A | 9/1991 | Koerner | |
| 5,101,539 | A | 4/1992 | Kennedy et al. | |
| 5,168,603 | A | 12/1992 | Reed | |
| 5,189,761 | A | 3/1993 | Chisholm | |
| 5,208,952 | A | 5/1993 | Mintel et al. | |
| 5,216,784 | A | 6/1993 | Dyer | |
| 5,260,015 | A | 11/1993 | Kennedy et al. | |
| 5,267,945 | A | 12/1993 | Doctor et al. | |
| 5,368,549 | A | 11/1994 | McVicker | |
| 5,499,859 | A | 3/1996 | Angell | |
| 5,537,719 | A * | 7/1996 | Freed | 24/16 PB |
| 5,604,961 | A | 2/1997 | Cole | |
| 5,605,373 | A | 2/1997 | Wildern, IV et al. | |
| 5,620,769 | A | 4/1997 | Wessels et al. | |
| 5,653,004 | A | 8/1997 | Russo | |
| 5,657,516 | A | 8/1997 | Berg et al. | |
| D389,051 | S | 1/1998 | Caveney et al. | |
| 5,704,480 | A | 1/1998 | Scholz et al. | |
| 5,722,123 | A | 3/1998 | Davignon et al. | |

(Continued)

FOREIGN PATENT DOCUMENTS

| | | |
|---|---|---|
| CN | 1272816 | 11/2000 |

(Continued)

*Primary Examiner* — Jack W. Lavinder
(74) *Attorney, Agent, or Firm* — Fish & Richardson P.C.

(57) ABSTRACT

Fastener products and related methods are disclosed. In some embodiments, the fastener products include an elongate strap defining an aperture and a row of projections extending from the elongate strap. A portion of the elongate strap including one or more of the projections can be passed through the aperture to retain the fastener product in a fastened state.

20 Claims, 13 Drawing Sheets

U.S. PATENT DOCUMENTS

| | | | |
|---|---|---|---|
| 5,766,723 | A | 6/1998 | Oborny et al. |
| 5,802,676 | A | 9/1998 | Tolan |
| 5,826,312 | A | 10/1998 | Schroder et al. |
| 5,827,547 | A | 10/1998 | Burchi et al. |
| 5,882,073 | A | 3/1999 | Burchi et al. |
| 5,945,193 | A | 8/1999 | Pollard et al. |
| 5,953,797 | A | 9/1999 | Provost et al. |
| 5,964,017 | A | 10/1999 | Roberts |
| 5,996,189 | A | 12/1999 | Wang |
| 6,044,525 | A | 4/2000 | Sastre et al. |
| 6,120,157 | A | 9/2000 | Westover |
| 6,129,970 | A | 10/2000 | Kenney et al. |
| 6,202,260 | B1 | 3/2001 | Clune et al. |
| 6,280,670 | B1 | 8/2001 | Buzzell et al. |
| 6,307,118 | B1 | 10/2001 | Reich |
| 6,317,933 | B1 | 11/2001 | Suenaga |
| 6,347,434 | B1 | 2/2002 | Newman |
| 6,432,339 | B1 | 8/2002 | Jens et al. |
| 6,443,187 | B1 | 9/2002 | Wang et al. |
| 6,467,132 | B1 | 10/2002 | Robley |
| 6,546,603 | B1 | 4/2003 | Wang et al. |
| 6,551,539 | B1 | 4/2003 | Leach et al. |
| 6,588,074 | B2 | 7/2003 | Galkiewicz et al. |
| 6,622,346 | B2 | 9/2003 | Graham et al. |
| 6,656,403 | B1 | 12/2003 | Clune et al. |
| 6,668,429 | B2 | 12/2003 | Fujisawa et al. |
| 6,676,674 | B1 * | 1/2004 | Dudai ..... 606/151 |
| 6,684,464 | B1 | 2/2004 | Mody et al. |
| 6,692,674 | B1 | 2/2004 | Kurtz et al. |
| 6,701,580 | B1 | 3/2004 | Bandyopadhyay |
| 2001/0013277 | A1 | 8/2001 | Galkiewicz et al. |
| 2002/0078536 | A1 | 6/2002 | Martin et al. |
| 2004/0040125 | A1 | 3/2004 | Schultz |
| 2004/0167456 | A1 | 8/2004 | Kingsford et al. |
| 2006/0032032 | A1 | 2/2006 | Cheng |

FOREIGN PATENT DOCUMENTS

| | | | |
|---|---|---|---|
| JP | 45-27594 | B | 10/1970 |
| JP | 55-84258 | U | 6/1980 |
| JP | 55-122612 | U | 9/1980 |
| JP | 64-2763 | U | 1/1989 |
| WO | WO 99/10161 | | 3/1999 |
| WO | WO 00/00407 | | 1/2000 |
| WO | WO 00/07792 | | 2/2000 |
| WO | WO 00/18556 | | 4/2000 |
| WO | WO 01/12022 | | 2/2001 |
| WO | WO 01/37710 | | 5/2001 |
| WO | WO 01/58302 | | 8/2001 |

* cited by examiner

FASTENER PRODUCTS AND RELATED METHODS

TECHNICAL FIELD

This invention relates to fastener products and related methods.

BACKGROUND

Elongate fastener strips can be used to retain articles in a bundle. For example, fastener strips can be wrapped around groupings of wires, tubes, or other objects to hold them in an ordered bundle. In some cases, a structural element is attached to the fastener strip. For example, a D-ring can be attached to one end of the fastener strip so that the opposite free end of the fastener strip may be looped through the D-ring and fastened to a more central region of the fastener strip.

Another type of fastener that can be used to retain articles is a zip tie. Zip ties are devices that typically include a strap and a head element. Multiple projections extend from the strap, and the head element defines a hole. The projections can be arranged along the strap such that they allow the strap to be pulled through the hole in one direction but not in the opposite direction. The projections can, for example, engage the head element to prevent movement of the strap in the opposite direction.

SUMMARY

In one aspect of the invention, a fastener product includes an elongate strap and first and second rows of projections extending from a surface of the elongate strap. The elongate strap defines an aperture and has a first end, a second end, a longitudinal axis extending between the first and second ends, and a hinge portion extending along the elongate strap substantially parallel to the longitudinal axis. The hinge portion is located between the first and second rows of projections and is configured to allow the elongate strap to be bent along the hinge portion such that a bent portion of the elongate strap including one or more projections of each of the first and second rows of projections can be passed through the aperture.

In another aspect of the invention, a fastener product includes an elongate strap and a row of projections extending from a surface of the elongate strap. The elongate strap defines an aperture and has a first end, a second end, and a longitudinal axis extending between the first and second ends. The aperture extends at an acute angle relative to the longitudinal axis of the elongate strap and has a length that is greater than or equal to a width of the elongate strap.

Embodiments can include one or more of the following features.

In some embodiments, the elongate strap includes a substantially uniform width along its length.

In certain embodiments, the hinge portion defines a crease extending along at least about 50 percent of the length of the elongate strap.

In some embodiments, the crease is a recess defined by the elongate strap.

In certain embodiments, the elongate strap has a thickness of at least about 50 percent less than a thickness of the elongate strap in a region outside of the recess.

In some embodiments, the hinge portion includes a portion of the elongate strap formed of a more flexible material than a material from which the remainder of the elongate strap is formed.

In certain embodiments, the first end of the elongate strap includes a tip portion having a width less than a remainder of the elongate strap. In some embodiments, a first rib extends from a surface of the elongate strap along a first edge region of the elongate strap.

In certain embodiments, the first rib extends from the surface from which the first and second rows of projections extend.

In some embodiments, the first rib extends from a surface of the elongate strap opposite the surface from which the first and second rows of projections extend.

In certain embodiments, a base region of the first rib is radiused.

In some embodiments, an end portion of the aperture is at least partially defined by the first rib.

In certain embodiments, a second rib extends from a surface of the elongate strap along a second edge region of the elongate strap.

In some embodiments, the second rib extends from the surface from which the first and second rows of projections extend.

In certain embodiments, the second rib extends from a surface of the elongate strap opposite the surface from which the first and second rows of projections extend.

In some embodiments, the base region of the second rib is radiused.

In certain embodiments, a backing layer is disposed along the surface of the elongate strap opposite the surface from which the first and second rows of projections extend.

In some embodiments, the backing layer includes a foam.

In certain embodiments, the backing layer includes a non-woven material.

In some embodiments, adjacent projections within the first and second rows of projections are longitudinally spaced by no more than about 0.2 inch.

In certain embodiments, at least some of the projections within the first and second rows of projections are configured to permit the bent portion of the elongate strap to be passed through the aperture with less resistance in a first direction than in a second direction opposite the first direction.

In some embodiments, at least some of the projections within the first and second rows of projections include an engageable side and a non-engageable side, the surface area of the engageable side being less than the surface area of the non-engageable side.

In certain embodiments, the engageable side intersects the non-engageable side to form an apex.

In some embodiments, the intersection of the engageable side with the non-engageable side forms a substantially triangular cross-sectional area.

In certain embodiments, at least some of the projections extend about 0.01 inch to about 0.05 inch from the surface of the elongate strap.

In some embodiments, the aperture is a slot.

In certain embodiments, at least one edge of the slot intersects at least two planes perpendicular to the elongate strap.

In some embodiments, the aperture is a u-shaped slot.

In certain embodiments, the aperture is substantially symmetrical about the hinge portion.

In some embodiments, the elongate strap defines only a single aperture through which a bent portion of the elongate strap can be passed.

In certain embodiments, a substantially unbent portion of the elongate strap including one or more of the projections can be passed through the aperture.

Embodiments can include one or more of the following advantages.

In some embodiments, the elongate strap includes a hinge portion about which the elongate strap can be bent. This arrangement permits the elongate strap to include an aperture (e.g., a u-shaped aperture, v-shaped aperture, etc.) having a width less than the width of the elongate strap. The elongate strap can, for example, be bent into the same shape as the aperture (e.g., a u-shape, v-shape, etc.). After being bent about the hinge portion, the bent portion of the elongate strap including one or more projections of each of the first and second rows of projections can be passed through the aperture. As a result of this arrangement, the fastener product can have a substantially uniform width from the first end to the second end of the elongate strap. The fastener product can thus be manufactured as a continuous product and cut to make straps of any of various different lengths.

In some embodiments, the fastener product includes only a small number of apertures (e.g., only a single aperture) along its length. The projections of the first and second rows of projections can cooperate with the aperture(s) to secure the fastener product in any of various different fastened positions. Due to the limited number of apertures along length of the elongate strap, the tensile strength of the elongate strap can be relatively high compared to other products that include a more substantial number of apertures along their length because less material is required to be removed from the elongate strap than from those other products. Thus, the use of fewer apertures per elongate strap can increase the structural integrity of the elongate strap.

In some embodiments, adjacent projections within the first and second rows of projections are spaced by no more than about 0.2 inch (e.g., no more than about 0.15 inch, no more than about 0.1 inch). The close spacing of adjacent projections allows finer adjustability of the elongate strap.

In certain embodiments, the fastener product includes a rib extending from a surface of the elongate strap along an edge region of the elongate strap. By providing increased material thickness along an edge region of the elongate strap, the rib can increase the tear resistance of the fastener across the width of the fastener.

In some embodiments, the rib of the fastener product extends from a surface of the elongate strap opposite the surface from which the first and second rows of projections extend. This arrangement can reduce the profile (e.g., the height) required for the projections to engage the aperture when the fastener product is in a fastened position. In some cases, this arrangement can also allow for the length of the aperture of the elongate strap to be reduced.

In certain embodiments, the fastener product includes a rib extending from a surface of the elongate strap and the aperture defined by the elongate strap extends partially into the rib. By defining at least a portion of the aperture, the increased material thickness of the rib can increase the tear resistance of the fastener in the direction of the longitudinal axis of the elongate strap.

In some embodiments, the fastener product includes a backing material disposed along a surface of the elongate strap opposite the surface from which the first and second rows of projections extend. The backing material can reduce damage (e.g., reduce abrasion) to the items bundled by cinching the elongate strap.

Other aspects, features, and advantages will be apparent from the description and drawings, and from the claims.

DETAILED DESCRIPTION

Figure 1:
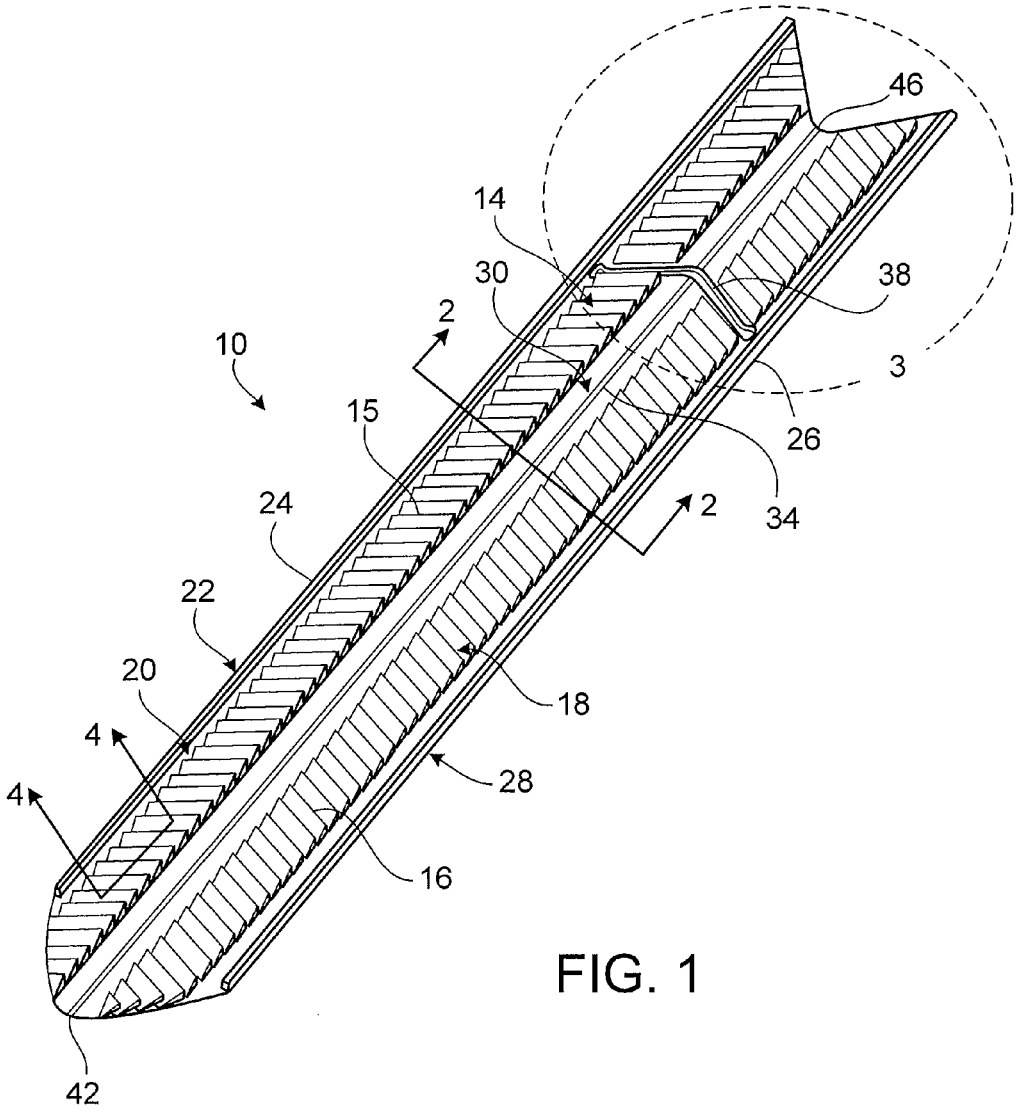
FIG. 1 is a perspective view of a fastener product with a hinge portion extending along its length.
Figure 2:
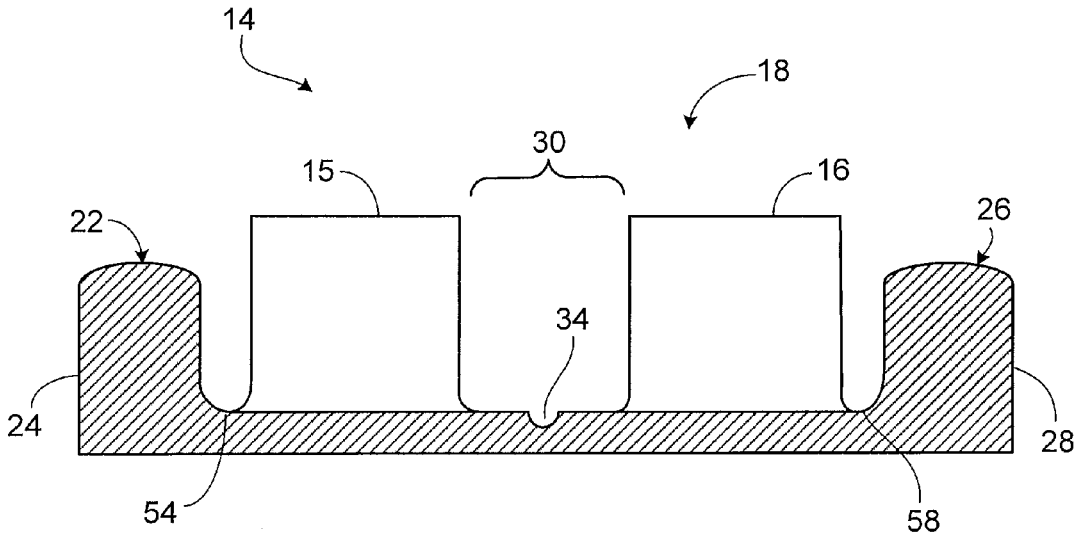
FIG. 2 is a cross-sectional view of the fastener product of FIG. 1, taken along line 2-2 in FIG. 1.

Referring to FIGS. 1 and 2, a fastener product 10 includes an elongate strap 20 defining an aperture (i.e., slit) 38. Elongate strap 20 is a continuous resin base extending from a tip region 42 to a tail region 46 of fastener product 10. Elongate strap 20 includes a hinge portion 30 extending the length of the strap along a center longitudinal axis defined by the strap. First and second rows of projections 14, 18 extend from a top surface of elongate strap 20, on respective sides of hinge portion 30. As will be described in further detail below, hinge portion 30 is flexible to allow elongate strap 20 to be bent about hinge portion 30 such that the bent portion of elongate strap 20 can be passed through aperture 38. As the bent portion of elongate strap 20 is passed through aperture 38, projections 15, 16 of first and second rows of projections 14, 18 engage a surface of elongate strap 20, adjacent aperture 38, to retain elongate strap 20 in a fastened position (e.g., by inhibiting motion of the bent portion of elongate strap 20 back through the aperture).

Elongate strap 20 includes a substantially uniform width along its length. In some embodiments, elongate strap 20 has a width of about 0.2 inches or more (e.g., about 0.5 inch or more, about 1.0 inch or more). In certain embodiments, elongate strap 20 has a width of about 0.25 inch to about 2.0 inches (e.g., about 0.5 inch to about 1.0 inch).

Hinge portion 30 defines a recess 34 extending the length of elongate strap 20 substantially along the center axis defined by the elongate strap. The region of hinge portion 30 along which recess 34 extends has a smaller thickness than the remainder of hinge portion 30 and, thus, can define an axis of maximum flexibility of fastener product 10. During use, such a defined axis of maximum flexibility can improve the repeatability of locating tip region 42 through aperture 38. For example, fastener product 10 can bend symmetrically about the longitudinal axis defined by recess 34. In some embodiments, the region of hinge portion 30 along which recess 34 extends has a thickness of less than about 70 percent (e.g., less than about 60 percent, less than about 50 percent) and/or more than about 30 percent (e.g., more than about 40 percent, more than about 50 percent) of the thickness of the remainder of hinge portion 30. In some embodiments, for example, the region of hinge portion 30 along which recess 34 extends has a thickness of about 0.001 inch to about 0.010 inch (e.g., about 0.005 inch) and the remainder of hinge portion 30 has a thickness of about 0.006 inch to about 0.020 inch (e.g., about 0.010 inch).

Tip region 42 of elongate strap 20 has a width less than the remainder of elongate strap 20. Tip region 42 is substantially v-shaped to facilitate, for example, passing tip region 42 through aperture 38. Tail region 46 defines a substantially v-shaped notch. As will be described in further detail below, the v-shaped notch of tail region 46 can be approximately the same dimensions as the v-shaped tip region 42 to allow, for example, for simplified and efficient manufacturing.

First and second ribs 22, 26 are integrally formed with elongate strap 20 and add material thickness along edge regions 24, 28 of elongate strap 20. Such added material thickness increases the tear resistance of elongate strap 20 and increases the ability of fastener product 10 to support a load (e.g., without plastic deformation).

First and second ribs 22, 26 extend from the same surface of elongate strap 20 from which first and second row of projections 14, 18 extend. In some embodiments, the total height of first and second ribs 22, 26 is about 1.5 times (e.g., about 2 times, about 3 times) the thickness of hinge portion 30. In some embodiments, each of first and second ribs 22, 26 include a width that is greater than the overall height of each respective rib.

Projections 15, 16 of first and second rows of projections 14, 18 extend above the elongate strap 20 to engage a surface of elongate strap 20 adjacent aperture 38 during use. In some embodiments, first and second row of projections 14, 18 extend above first and second ribs 22, 26. For example, projections 15, 16 can extend about 0.01 inch to about 0.05 inch (e.g., about 0.02 inch) above first and second ribs 22, 26. In some embodiments, reducing the overall height of projections 15, 16 can reduce the overall height of the fastener product 10.

Base regions 54, 58 of first and second ribs 22, 26 are radiused and connect to first and second rows of projections 14, 18, respectively. Such radiused base regions 54, 58 can reduce stress concentrations in fastener product 10 by reducing sharp transitions in material thickness. Base regions 54, 58 can also increase tear resistance of fastener product 10 by adding material thickness along elongate strap 20.

Figure 3:
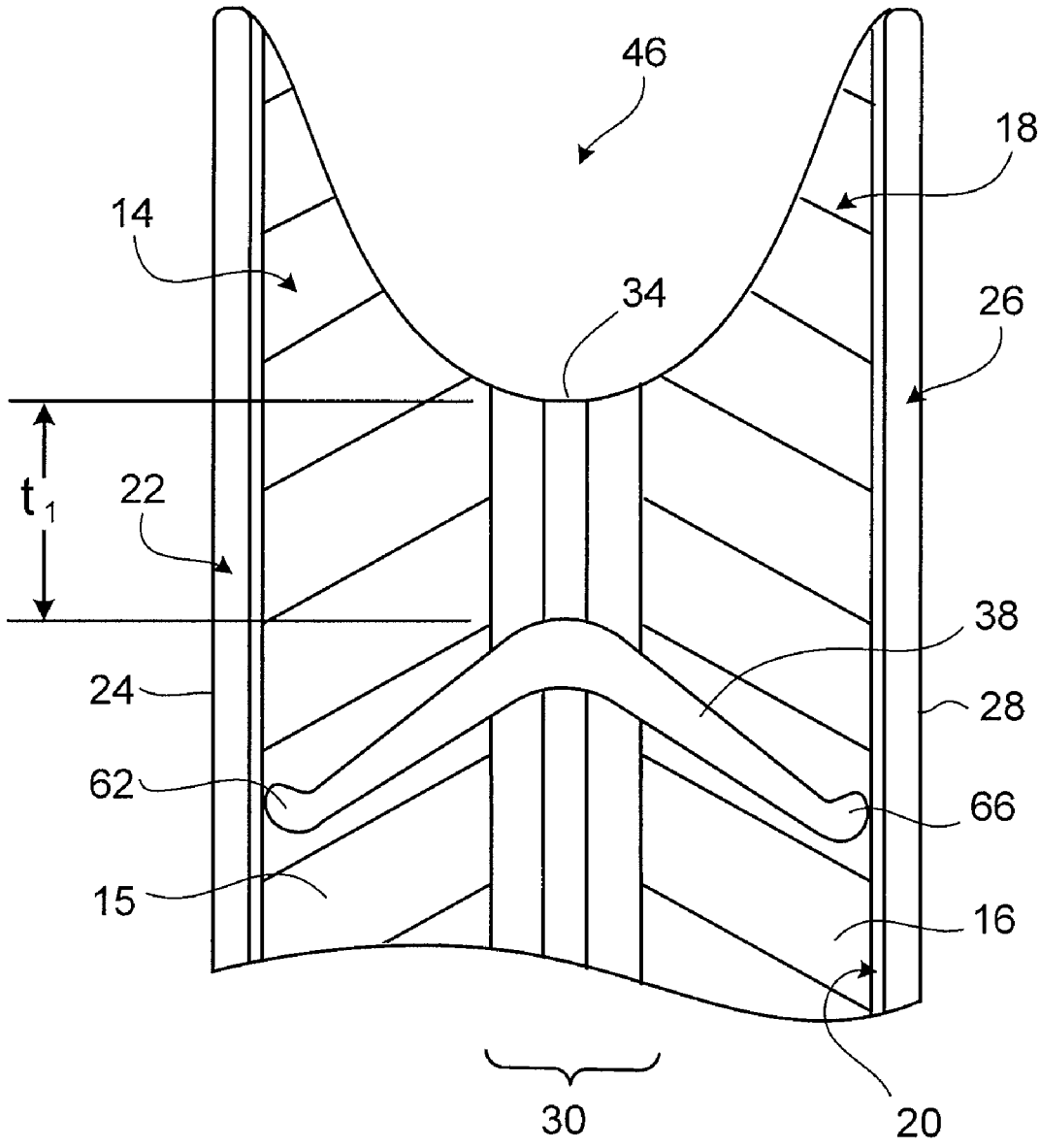
FIG. 3 is an enlarged top view of region 3 of the fastener product of FIG. 1.

Referring now to FIG. 3, elongate strap 20 defines aperture 38 near tail region 46. Aperture 38 is placed along the length of elongate strap 20 to maintain a thickness $t_1$ near tail region 46. Thickness $t_1$ can increase tear resistance near tail region 46 of elongate strap 20. In some embodiments, thickness $t_1$ is at least about 0.25 inch. For example, thickness $t_1$ can be about 0.125 inch to about 0.75 inch (e.g., about 0.25 inch).

The distance between tip region 42 and aperture 38 is approximately the maximum circumference of fastener product 10 in the fastened position.

Aperture 38 is substantially unshaped and symmetrical about hinge portion 30. Aperture 38 allows first and second rows of projections 14, 18 to engage elongate strap 20 in the fastened position with substantially equal force. Aperture 38 includes first and second end regions 62, 66. A distance extending along aperture 38, between first and second regions 62, 66, is greater than or equal to the width of elongate strap 20. For example, the distance extending along aperture 38, between first and second regions 62, 66, can be about 2 percent to about 30 percent (e.g., about 10 percent) greater than the width of elongate strap 20.

As shown in FIGS. 2 and 3, first and second end regions 62, 66 of aperture 38 extend into base regions 54, 58, respectively. As a result, the tear resistance of elongate strap 20 in the longitudinal direction is increased. For example, due to the increased thickness of the strap at base regions 54, 58, a tear is less likely to propagate along base regions 54, 58 than along the thinner portions of the strap through which aperture 38 extends. It is particularly advantageous for opposite ends of aperture 38 to terminate within base regions 54, 58 of ribs 22, 26 because tears tend to be more likely to propagate from ends of apertures. First and second ribs 22, 26 sit in first and second end regions 62, 66, respectively, when fastener product 10 is in a fastened position. Additionally or alternatively, first and second end regions 62, 66 are each shaped to allow first and second ribs 22, 26, respectively, to slide through aperture 38 with reduced resistance as fastener product 20 is fastened.

Figure 4:
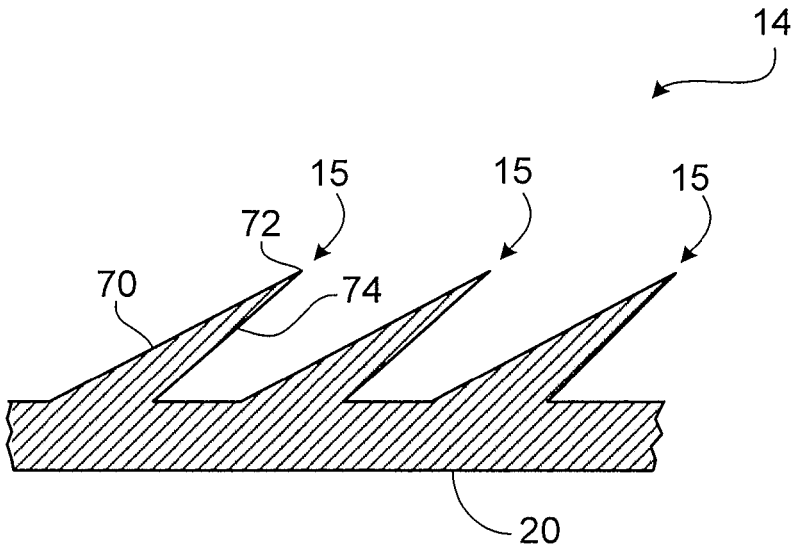
FIG. 4 is a cross-sectional view of the fastener product of FIG. 1, taken along line 4-4 in FIG. 1.
Figure 5:
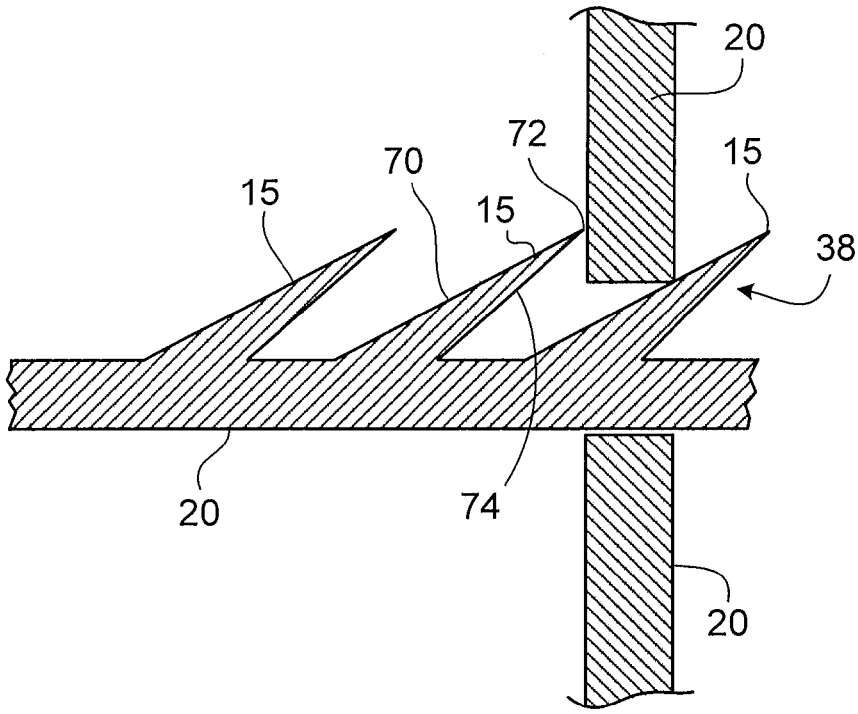
FIG. 5 is a partial, cross-sectional, side view of the fastener product of FIG. 1 after fastening.

Referring now to FIGS. 3-5, projections 15, 16 of first and second rows of projections 14, 18 are integrally formed with elongate strap 20 and extend from a surface of the strap. Adjacent projections 15, 16 within respective first and second rows of projections 14, 18 extend substantially parallel to one another to allow, for example, multiple different fastening positions of fastener product 10 during use. In general, narrower longitudinal spacing of adjacent projections within first and second rows of projections 14, 18 can improve control over the degree of tightening of fastener product 10. Adjacent projections within the first and second rows of projections 14, 18 can be longitudinally spaced by any of various different dimensions. In some embodiments, adjacent projections within first and second rows of projections 14, 18 are spaced apart from one another by less than about 0.6 inch (e.g., less than about 0.5 inch, less than about 0.4 inch, less than about 0.3 inch, less than about 0.2 inch) and/or greater than about 0.1 inch (e.g., greater than about 0.2 inch, greater than about 0.3 inch, greater than about 0.4 inch, greater than about 0.5 inch). In some embodiments, for example, adjacent projections within first and second rows of projections 14, 18 are spaced apart from one another by about 0.03 inch to about 0.3 inch (e.g., about 0.2 inch).

First and second rows of projections 14, 18 are symmetrical about recess 34. Such a symmetrical orientation of first and second rows of projections 14, 18 can allow substantially equal distribution of forces (e.g., tensile, shear) on each side of recess 34 when fastener product 10 is in a fastened position (shown in FIG. 5). In some embodiments, such equal distribution of forces can improve the ability of fastener product 10 to resist damage (e.g., kinking, tearing) during use.

Each projection 15, 16 in first and second rows of projections 14, 18, respectively, extends to a height of about 0.01 inch to about 0.25 inch (e.g., about 0.05 inch) above the top surface of the base portion of elongate strap 20. Each projection 15, 16 extends at an angle relative to the center axis defined by elongate strap 20. Angling each projection 15, 16 relative to the longitudinal axis can change the forces acting on the projections as the projections engage the surface of elongate strap 20 adjacent aperture 38. Each projection 15, 16 in first and second rows of projections 14, 18, respectively, can extend at an acute angle of about 15 degrees to about 75 degrees (e.g., about 45 degrees) relative to the longitudinal axis of elongate strap 20, facing toward tip region 42. This acute angle arrangement can reduce the amount of force required to pull tip region 42 through aperture 38 to tighten fastener product 10.

Hinge portion 30 can have any of various different widths to separate first and second rows of projections 14, 18. For a given material and a given width of elongate strap 20, a wider hinge portion 30 can increase the flexibility of fastener product 10 while a narrower hinge portion 30 can increase the maximum load supported by fastener product 10. In certain embodiments, hinge portion 30 has a width of about 0.02 inch to about 0.375 inch (e.g., about 0.06 inch).

As shown in FIG. 5, which illustrates a portion of elongate strap 20 being pulled through aperture 38, each projection 15 is shaped to allow the elongate strap 20 to move through aperture 38 with less resistance in the fastening direction than in a direction opposite the fastening direction. Each projection 15 includes a non-engageable surface 70 and an engageable surface 74. Non-engageable surface 70 is inclined relative to the base at about 15 degrees to about 75 degrees. Engageable surface 74 is inclined relative to the base at a steeper angle such that the surface area of engageable surface 74 is less than the surface area of non-engageable surface 70. Engageable surface 74 intersects non-engageable surface 70 near an apex region 72 forming a substantially triangular cross-sectional area of projection 15. Apex region 72 is flexible in a direction facing into non-engageable surface 70 (e.g., generally toward the base portion of elongate strap 20 from which projections 15, 16 extend). Apex region 72 resists flexure in a direction facing into engageable surface 74 (e.g., generally away from the base portion of elongate strap 20 from which projections 15, 16 extend). For the purpose of illustration and explanation, the portion of elongate strap 20 including projections 15 and first row of projections 14 has been described above. The portion of elongate strap 20 including projections 16 and second row of projections 18 includes an analogous configuration.

In use, tip region 42 is bent to align substantially with aperture 38 of elongate strap 20. Pulling elongate strap 20 (e.g., by pulling tip region 42) through aperture 38 causes non-engageable surface 70 to contact elongate strap 20 along aperture 38. The force of elongate strap 20 acting on non-engageable surface 70 causes apex region 72 to flex in a direction opposite the fastening direction. Flexure of apex region 72 allows projection 15 to pass through aperture 38. Upon exiting aperture 38, apex region 72 returns to a substantially non-flexed orientation with at least a portion of engageable surface 74 in contact with elongate strap 20. The contact between the engageable surface 74 and the elongate strap 20 provides resistance against motion of elongate strap 20 in a direction opposite the fastening direction (e.g., providing a fastening force).

Figure 6:
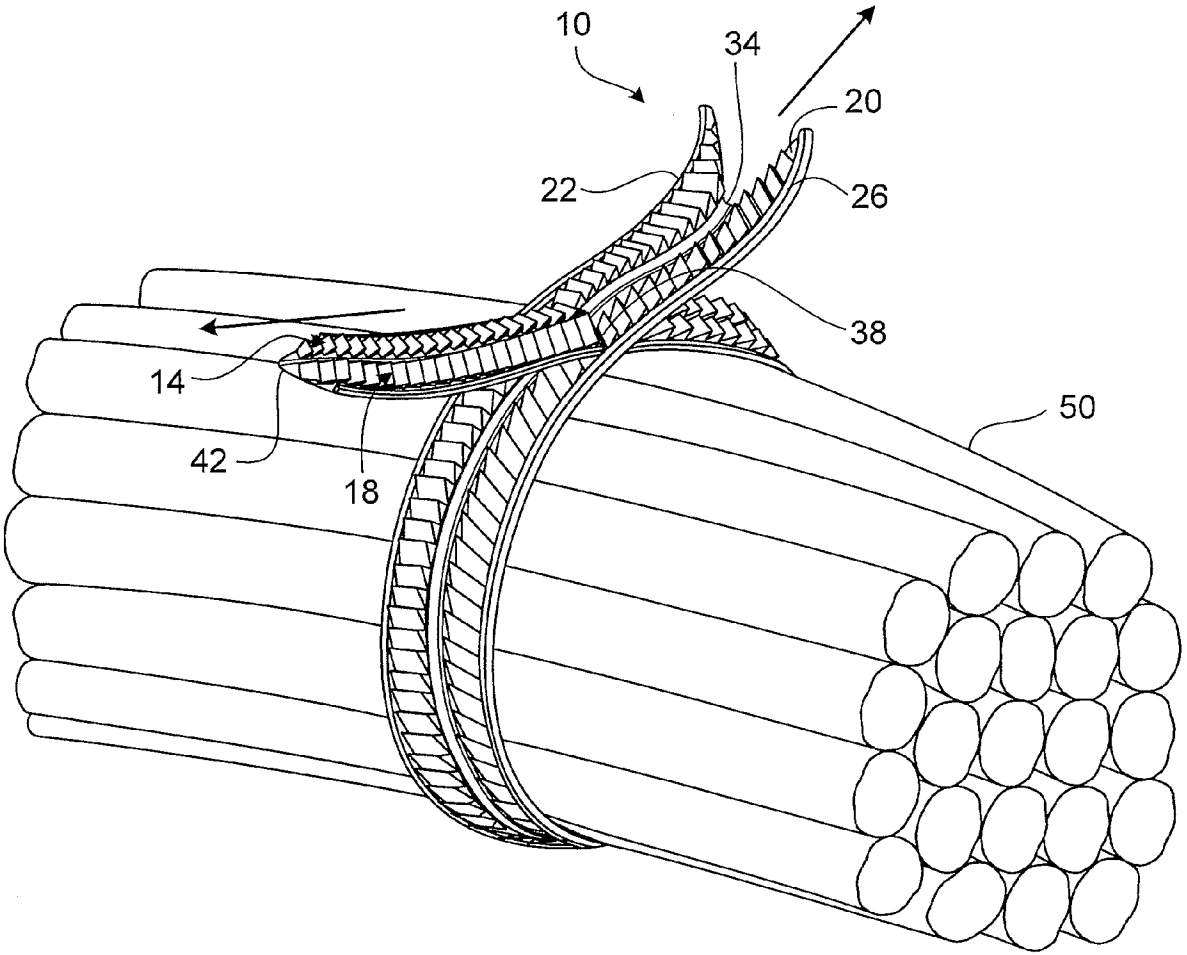
FIG. 6 is a perspective view of the fastener product of FIG. 1 wrapped about a bundle of wires.

As shown in FIG. 6, elongate strap 20 is adapted to cooperate with the aperture such that the fastener product 10 can be wrapped around a group of articles and fastened to retain the articles in a bundle, for example. Other uses are also contemplated.

The substantially uniform width of elongate strap 20 can increase the efficiency of and decrease the cost of the manufacturing process used to produce fastener product 10. For example, as described in further detail below, fastener product 10 can be manufactured as a continuous product and cut to any length. Additionally or alternatively, this substantially uniform width can reduce the amount of material required to produce fastener product 10, making the manufacturing process more cost efficient as compared to straps that include enlarged heads defining apertures through which the end portion of the strap can be passed.

Figure 7:
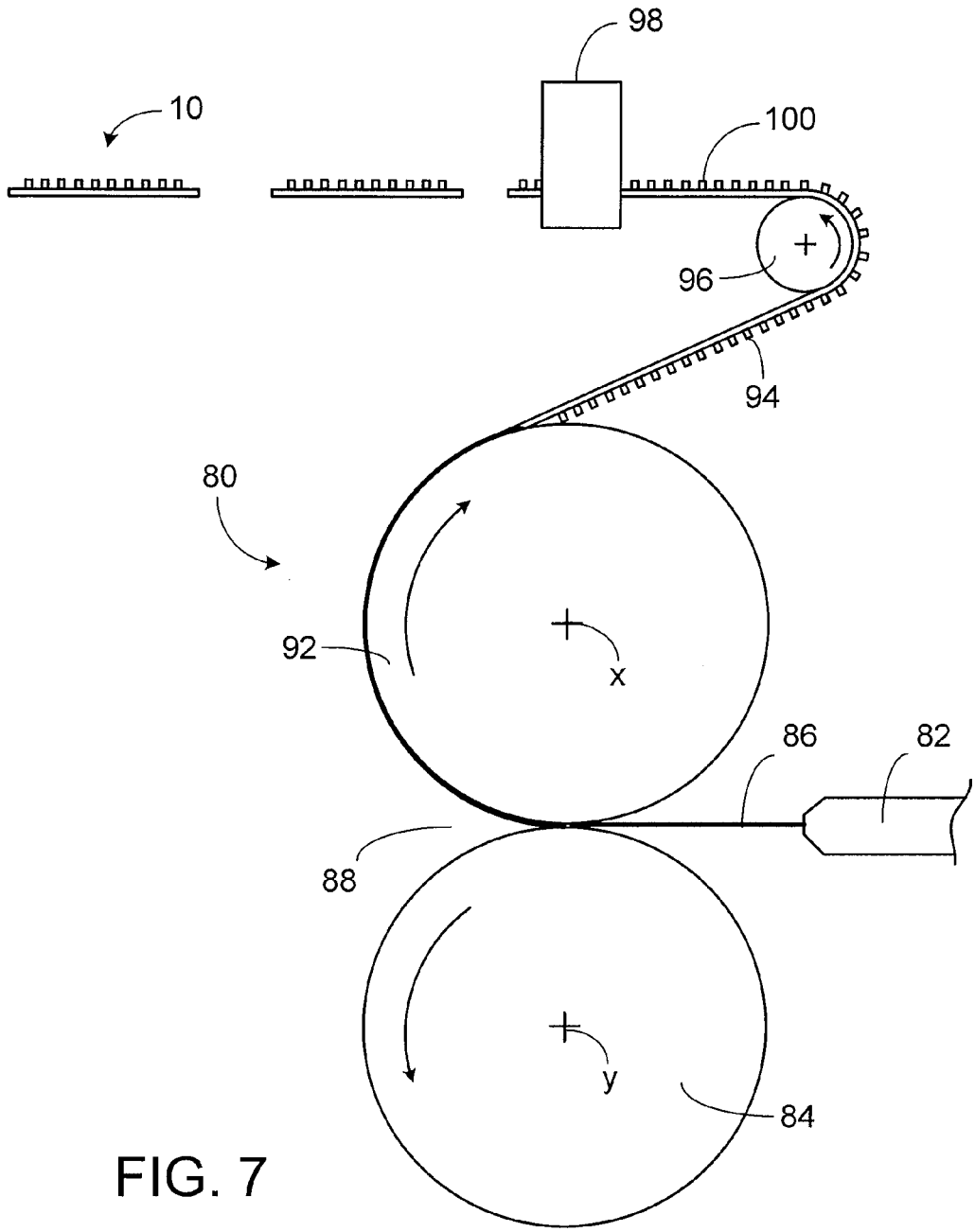
FIG. 7 illustrates a method and apparatus for producing the fastener product of FIG. 1.

FIG. 7 illustrates a method and apparatus 80 for making the above-described fastener product 10. Apparatus 80 includes an extruder 82, a mold roll 92, a counter-rotating pressure roll 84, a stripping roll 96, and a separating device 98. Extruder 82 extrudes a sheet of resin 86 into a pressure nip 88 formed between a peripheral surface of mold roll 92 and pressure roll 84. Resin 86 is then conveyed around mold roll 92 toward stripping roll 96. Stripping roll 96 strips resin 86 from mold roll 92 to expose a continuous fastener product sheet 100. Fastener product sheet 100 is then conveyed through a separating device 98 where it is separated into multiple, discrete fastener products 10.

Extruder 82, as noted above, extrudes a sheet of molten resin 86 into pressure nip 88. A die can be attached to the outlet of the extruder to affect the manner in which the resin is extruded. For example, the die can include a continuous slot that allows the resin to be extruded in a continuous sheet. Alternatively, the die can include multiple discrete slots causing the resin to be extruded into multiple discrete lanes.

Molten resin 86 can be one of various suitable materials capable of being molded and retaining the molded shape. Suitable materials include, for example, thermoplastic materials, such as polypropylene, polyethylene, polyamides, and nylon 6,6.

Figure 8:
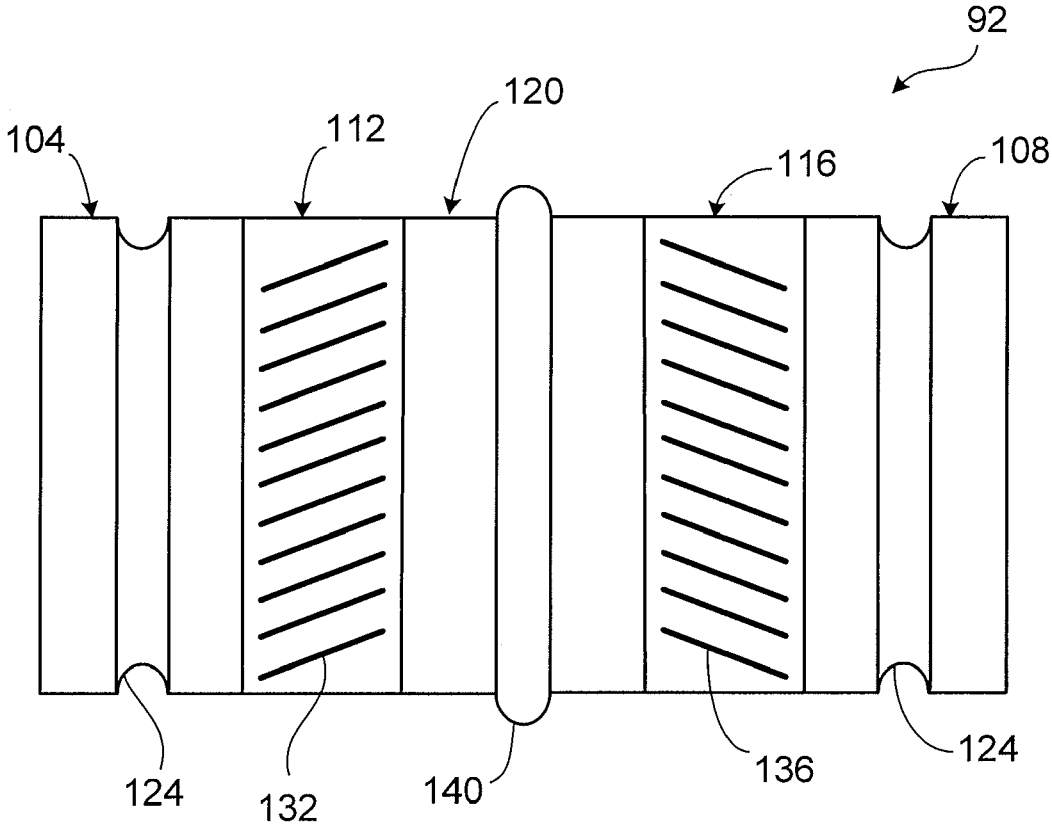
FIG. 8 is a front view of a mold roll of the apparatus of FIG. 7.

Referring to FIGS. 7 and 8, mold roll 92 is configured to form features of fastener product 10 from molten resin 86. Mold roll 92 includes a first rib plate 104, a second rib plate 108, a first projection plate 112, a second projection plate 116, and a hinge plate 120. The plates 104, 108, 112, 116, 120 are disposed about a mandrel (not shown) configured to substantially prevent relative motion of the plates during the manufacturing process. Hinge plate 120 is arranged between first and second projection plates 112, 116. First and second rib plates 104, 108 are arranged on respective ends of mold roll 92.

Hinge plate 120 forms hinge portion 30 of elongate strap 20. Hinge plate 120 includes a raised surface 140 extending around the hinge plate along a central portion of mold roll 92. Raised surface 140 cooperates with pressure roll 84 to form recess 34 of hinge portion 30.

First and second projections plates 112, 116 define first and second recesses 132, 136, respectively. During manufacturing, pressure in nip 88 forces molten resin 86 into first and second recesses 132, 136 to form projections 15, 16 of first and second rows of projections 14, 18, respectively. First and second recesses 132, 136 can include rounded edges near the surface of first and second projection plates 112, 116, respectively, to at least a portion of a radiused transition between projections 15, 16 and first and second ribs 22, 26, respectively.

First and second rib plates 104, 108 each define a groove 124 extending around a circumference of each of the first and second rib plates. During manufacturing, pressure in nip 88 forces molten resin 86 into grooves 124 to form first and second ribs 22, 26. Grooves 124 can include rounded edges configured to form at least a portion of base regions portions 54, 58 along the base of ribs 22, 26, respectively.

Figure 9:
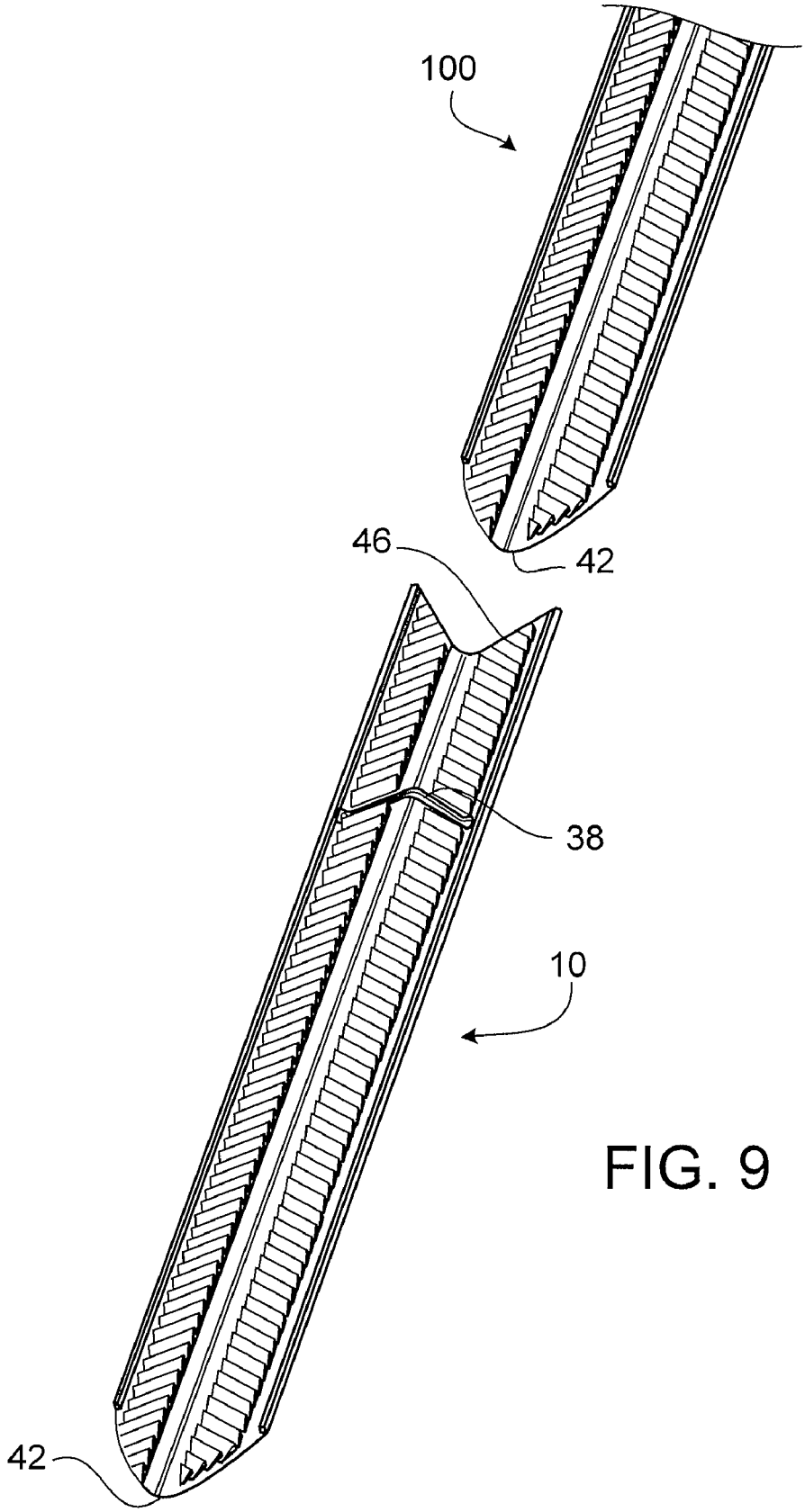
FIG. 9 is a top view of a fastener product of the type shown in FIG. 1 being detached from a continuous length of fastener preform material.

Referring to FIGS. 7 and 9, continuous fastener product 100 passes through separating device 98. Separating device 98 cuts (e.g., die cuts) continuous fastener product 100 to length and defines aperture 38 to form fastener product 10. In some embodiments, a single cutting operation cuts continuous fastener product 100 to length and defines aperture 38. Such a single cutting operation can, for example, increase throughput of manufacturing process 80.

The cutting operation forms tip region 42 in a substantially v-shape to facilitate alignment of the tip region with aperture 38. Tail region 46 of a successive strap defines a notch shape complementary to the substantial v-shape of tip region 42. Complementary shapes of tip and tail regions 42, 46 can be useful, for example, for minimizing waste associated with forming fastener product 10 from continuous fastener product 100.

Figure 10:
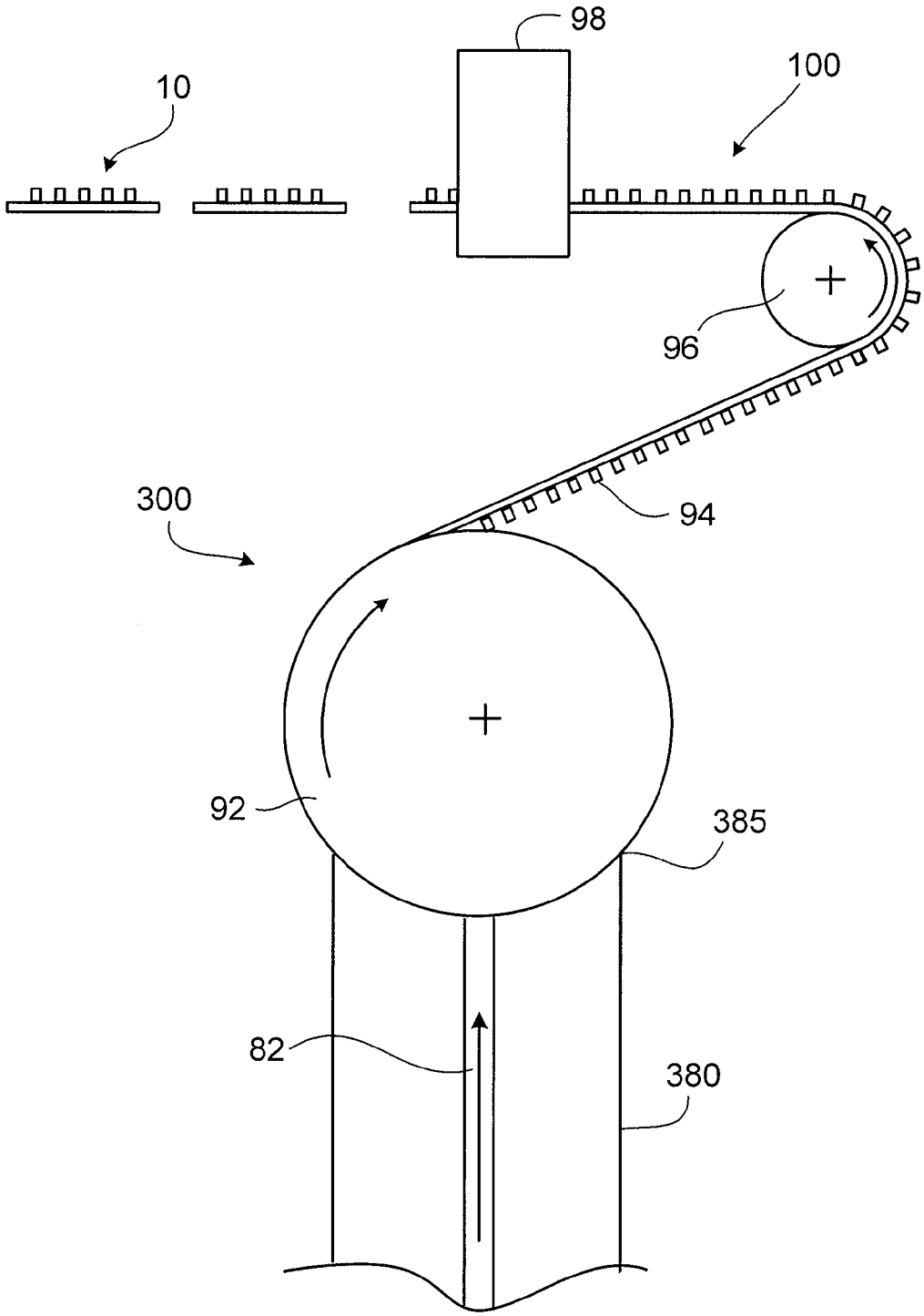
FIG. 10 illustrates another method and apparatus for producing the fastener product of FIG. 1.

FIG. 10 illustrates another method and apparatus 300 capable of producing fastener products similar to the product shown in FIG. 1. Method and apparatus 300 is similar to the method and apparatus 80, shown in FIG. 7. Extruder 82, however, includes an arcuate housing 380 and is positioned adjacent mold roll 92 to define a gap 385 between housing 380 and the peripheral surface of mold roll 92. Extruder 82 extrudes resin into the gap 385. Due to the configuration of the extruder housing 380 relative to the mold roll 92, a large amount of pressure is developed within the gap 385. Due to the pressure within gap 385, the resin is pressed into grooves 124 (shown in FIG. 8) to form first and second ribs 22, 26. Pressure within gap 385 also presses resin into first and second recesses 132, 136 (shown in FIG. 8) to form projections 15, 16 of first and second rows of projections 14, 18.

While certain embodiments have been described, other embodiments are possible.

Figure 11:
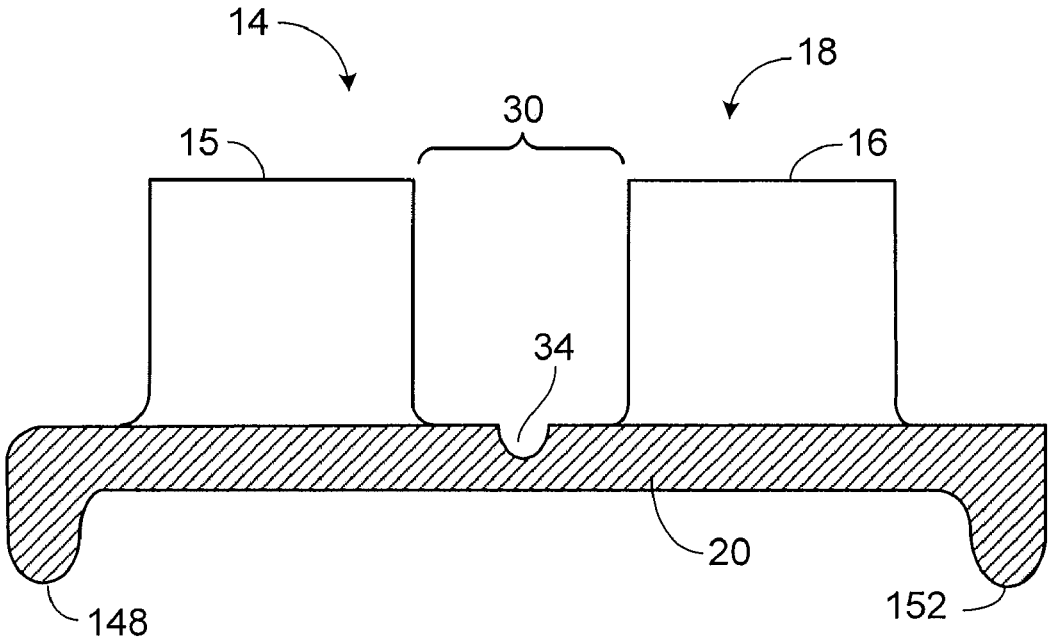
FIG. 11 is a cross-sectional view of a fastener product that includes a rib extending from the bottom surface of an elongate strap of the fastener product.

As an example, while first and second ribs 22, 26 have been described as extending from elongate strap 20 along the same surface as first and second rows of projections 14, 18, other embodiments are possible. In some embodiments, referring to FIG. 11, first and second ribs 148, 152 extend from the bottom surface of elongate strap 20 while first and second rows of projections 14, 18 extend from the top surface. Such an arrangement of ribs 148, 152 can, for example, reduce the overall height of fastener product 10 (e.g., by allowing lower profile projections 15, 16 to engage with surfaces of elongate strap 20 defining aperture 38).

In certain embodiments, first and second ribs extend from both the top and bottom surfaces of the elongate strap. For example, a portion (e.g., half) of first and second ribs can extend from the top surface of the elongate strap while another portion (e.g., half) first and second ribs can extend from the bottom surface of the elongate strap.

Figure 12:
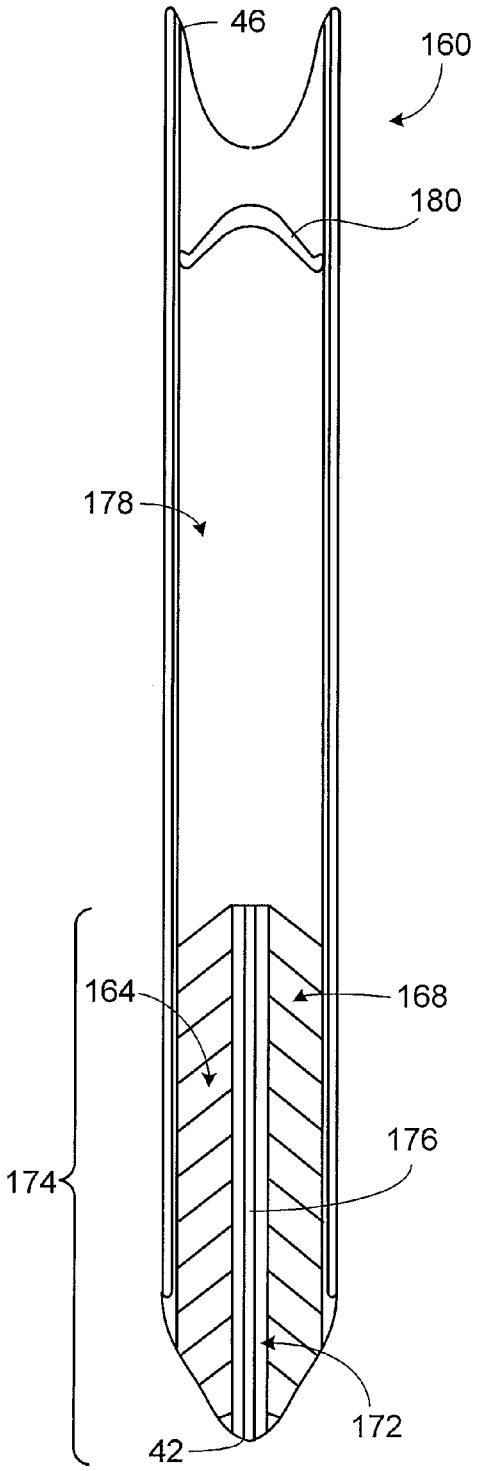
FIG. 12 is a top view of a fastener product with rows of projections that extend only along a partial length of the fastener product.

As another example, while first and second rows of projections 14, 18, hinge portion 30, and recess 34 have each been described as extending along the entire length of elongate strap 20, other embodiments are possible. For example, as shown in FIG. 12, a fastener product 160 includes first and second rows of projections 164, 168, a hinge portion 172, and a recess 176 each extending along only a portion of the length of an elongate strap 178 near a tip region 174. Such an arrangement of first and second rows of projections 164, 168 can define a minimum circumference of fastener product 160 in a fastened state (e.g., to lessen the possibility of over-tightening fastener product 160 around an object).

Figure 13:
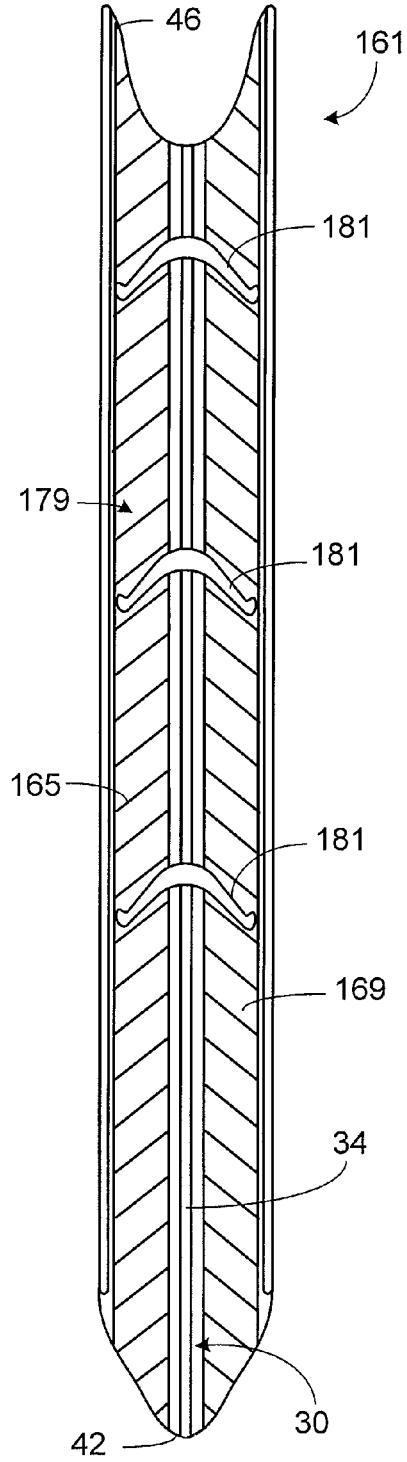
FIG. 13 is a top view of a fastener product that includes multiple, longitudinally spaced apertures.

As still another example, while the elongate strap of the above-described fastener product defines a single aperture, an elongate strap can define multiple apertures. For example, referring to FIG. 13, elongate strap 179 defines multiple apertures 181. Such multiple apertures can allow fastener product 161 to be cut to a desired length (e.g., prior to use) while still retaining tip portion 42. In general, the use of fewer apertures per elongate strap increases the structural integrity of elongate strap. While first and second rows of projections 165, 169 are shown as extending substantially the entire length of elongate strap 179, they can alternatively extend along only a portion of the length of the strap.

As yet another example, while the apertures in the fastener products above have been described as substantially u-shaped, other shapes are possible. The aperture can be any of various, different shapes suitable to allow tip region to pass through the aperture and then allow the projections to engage the elongate strap in a fastened position. The aperture can, for example, be in the form of any of various different shaped slots defining a centerline that intersects at least two planes perpendicular to elongate strap. Some examples of suitable shapes for the slot include: substantially v-shaped, substantially w-shaped, substantially semi-circular.

While the apertures of embodiments above have been described as slots, other types of apertures can alternatively or additionally be used. In some embodiments, for example, a circular or oval shaped aperture is used.

Figure 14:
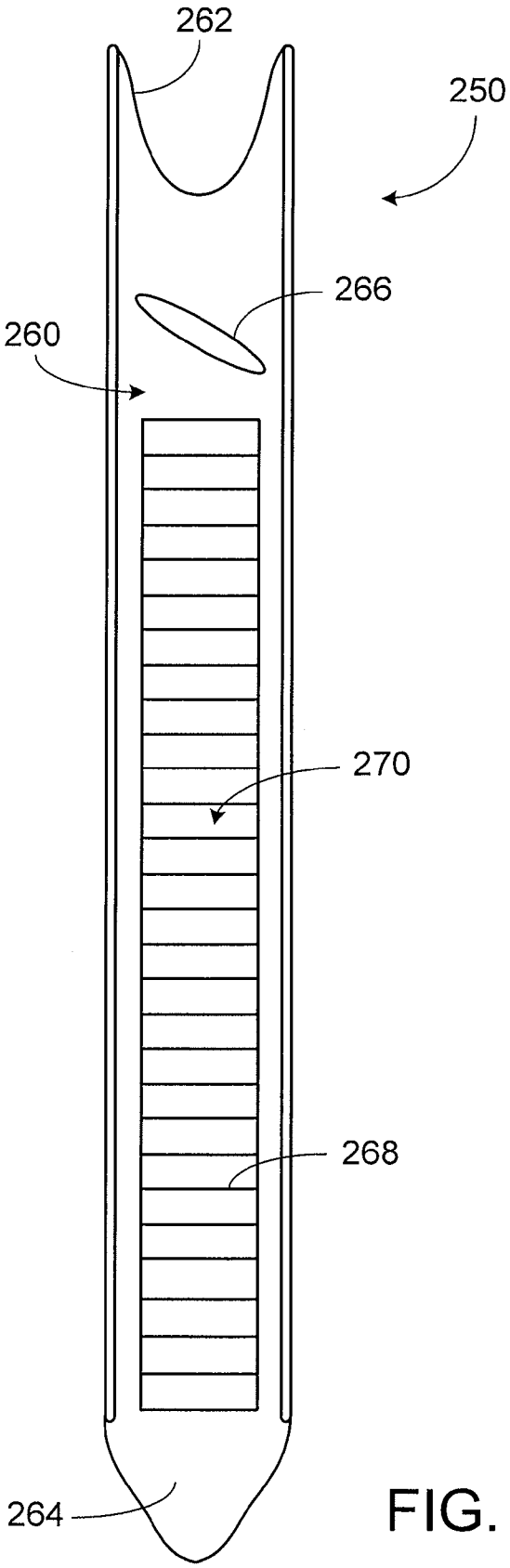
FIG. 14 is a top view of a fastener product that includes a single row of projections and an elongate slot extending at an acute angle relative to the longitudinal axis of the fastener product.

As still another example, while the fastener products above have been described as including a first and a second row of projections, other embodiments are possible. For example, as shown in FIG. 14, a fastener product 250 includes an elongate strap 260 defining an aperture 266. Aperture 266 extends at an acute angle (e.g., about 15 degrees to about 75 degrees, about 30 degrees to about 60 degrees) relative to the longitudinal axis of elongate strap 260. A length of aperture 266 (e.g., measured along a major axis of aperture 266) is greater than or equal to a width of elongate strap 260. Elongate strap 260 includes a tip region 264 and a tail region 262. A row 270 of projections 268 extend from a surface of elongate strap 260. Projections 268 are substantially perpendicular to a longitudinal axis defined by elongate strap 260. In use, a substantially unbent portion of elongate strap 260 including projections 268 can be passed through the aperture 266. In the fastened position, projections 268 engage a portion of elongate strap 260 defining aperture 266.

As another example, while the apertures in the fastener products have been described as substantially symmetrical about the hinge portion of the elongate strap, such symmetry is not required.

As another example, while the tip region of the above-described fastener product has been described as having a substantially v-shape, other embodiments are possible. For example, the tip region can have a substantially rounded (e.g., semi-circular) shape. As another example, the tip region can have a substantially square shape.

As yet another example, while the hinge portions of the fastener products described above have been described as defining a recess, other embodiments are possible. For example, the hinge portion can additionally or alternatively include other types of creases (e.g., a line of weakness, a perforation). In certain embodiments, the hinge portion does not include a crease. For example, the hinge portion can include a constant thickness, and the hinge portion can be made of a material sufficiently flexible to allow the hinge portion to bend about a longitudinal axis of the elongate strap.

As yet another example, while the hinge portions of the fastener products described above have been described as extending along a center longitudinal axis defined by the strap, other embodiments are possible. In some embodiments, the hinge portion is laterally spaced from the center longitudinal axis defined by the strap.

As still another example, while fastener product 10 has been described as including first and second ribs 22, 26, some embodiments include no ribs.

As yet another example, while fastener product 10 has been described as being formed of a single resin, other embodiments are possible. For example, different materials can be introduced into different areas of the nip 88 depending on the desired fastener product characteristics. For example, if it is desired to produce fastener product 10 including hinge portion 30 with different physical characteristics (e.g., more flexible material in hinge portion 30) from the remainder of elongate strap 20, then different materials can be introduced to the corresponding regions of the mold roll responsible for forming hinge portion 30 and the remainder of elongate strap 20.

As yet another example, while the above-described fastener product includes an elongate strap forming a continuous resin base, the elongate strap can include additional materials. For example, the elongate strap can include a backing layer on the side of the elongate strap opposite the projections. The backing layer can lessen abrasion of a bundled object, for example, by cushioning the bundled object. The backing layer can be made of any of various materials, including foam material and nonwoven material.

Figure 15:
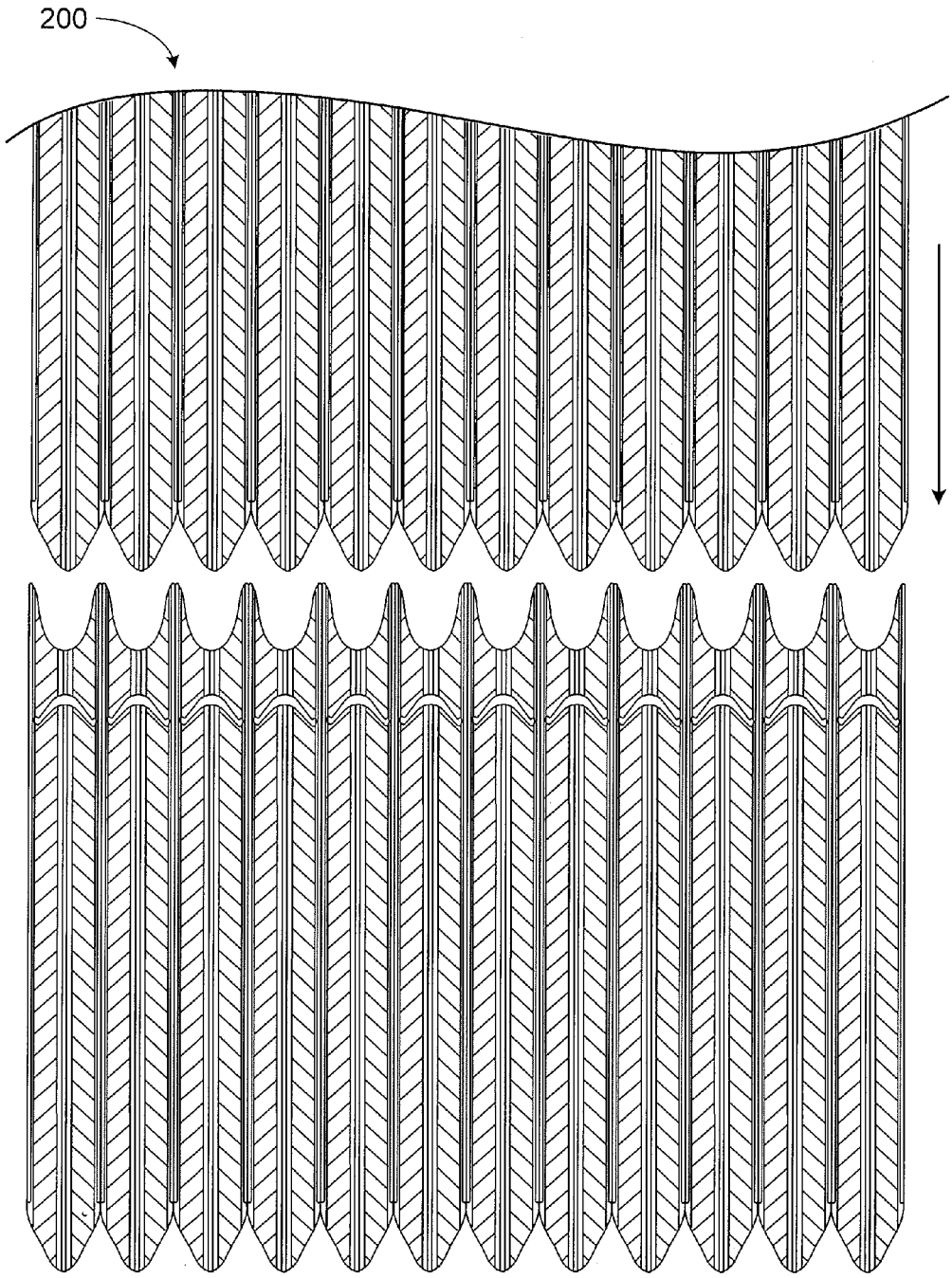
FIG. 15 is a top view of a fastener product sheet that can be separated to produce multiple fastener products of the type shown in FIG. 1.

As another example, while the above-described manufacturing process includes cutting individual fastener products from a continuous fastener product, other arrangements are possible. For example, as shown in FIG. 15, a manufacturing process can produce a continuous fastener product sheet 200. Sheet 200 can be cut longitudinally and transversely to provide multiple, discrete fastener products.

What is claimed is:

1. A fastener product comprising:

an elongate strap defining an aperture, the elongate strap having a first end, a second end, a longitudinal axis extending between the first and second ends, and a hinge portion extending along the elongate strap substantially parallel to the longitudinal axis, the first end of the elongate strap including a tip portion having a width less than a remainder of the elongate strap, and the remainder of the elongate strap having a uniform width along its length; and first and second rows of projections extending from a top surface of the elongate strap, the hinge portion being located between the first and second rows of projections, and the hinge portion being configured to allow the elongate strap to be bent along the hinge portion such that a bent portion of the elongate strap comprising one or more projections of each of the first and second rows of projections can be passed through the aperture.

2. The fastener product of claim 1, wherein the hinge portion comprises a portion of the elongate strap formed of a more flexible material than a material from which the remainder of the elongate strap is formed.

3. The fastener product of claim 1, further comprising a first rib extending from a surface of the elongate strap along a first edge region of the elongate strap.

4. The fastener product of claim 3, further comprising a second rib extending from a surface of the elongate strap along a second edge region of the elongate strap.

5. The fastener product of claim 1, further comprising a backing layer disposed along the surface of the elongate strap opposite the surface from which the first and second rows of projections extend.

6. The fastener product of claim 5, wherein the backing layer comprises a foam.

7. The fastener product of claim 5, wherein the backing layer comprises a nonwoven material.

8. The fastener product of claim 1, wherein adjacent projections within the first and second rows of projections are longitudinally spaced by no more than about 0.2 inch.

9. The fastener product of claim 1, wherein at least some of the projections within the first and second rows of projections are configured to permit the bent portion of the elongate strap to be passed through the aperture with less resistance in a first direction than in a second direction opposite the first direction.

10. The fastener product of claim 1, wherein at least some of the projections within the first and second rows of projections include an engageable side and a non-engageable side, the surface area of the engageable side being less than the surface area of the non-engageable side.

11. The fastener product of claim 10, wherein the engageable side intersects the non-engageable side to form an apex.

12. The fastener product of claim 11, wherein the intersection of the engageable side with the non-engageable side forms a substantially triangular cross-sectional area.

13. The fastener product of claim 1, wherein the aperture is a slot.

14. The fastener product of claim 13, wherein at least one edge of the slot intersects at least two planes perpendicular to the elongate strap.

15. The fastener product of claim 1, wherein the aperture is a u-shaped slot.

16. The fastener product of claim 1, wherein the elongate strap defines only a single aperture through which a bent portion of the elongate strap can be passed.

17. The fastener product of claim 1, wherein the projections extend at an acute angle relative to the longitudinal axis of the elongate strap.

18. A fastener product comprising:

an elongate strap defining an aperture, the elongate strap having a first end, a second end, a longitudinal axis extending between the first and second ends, and a hinge portion extending along the elongate strap substantially parallel to the longitudinal axis;

first and second rows of projections extending from a surface of the elongate strap, the hinge portion being located between the first and second rows of projections, and the hinge hinge portion being configured to allow the elongate strap to be bent along the hinge portion such that a bent portion of the elongate strap comprising one or more projections of each of the first and second rows of projections can be passed through the aperture; and a first rib extending from a surface of the elongate strap along a first edge region of the elongate strap, wherein an end portion of the aperture is at least partially defined by the first rib.

19. A fastener product comprising:

an elongate strap defining an aperture, the strap having a first end, a second end, and a longitudinal axis extending between the first and second ends, the first end of the elongate strap including a tip portion having a width less than a remainder of the elongate strap, and the remainder of the elongate strap having a uniform width along its length, the aperture extending at an acute angle relative to the longitudinal axis of the elongate strap, and the aperture having a length that is greater than or equal to a width of the elongate strap; and a row of projections extending from a top surface of the elongate strap.

20. The fastener product of claim 19, wherein a substantially unbent portion of the elongate strap comprising one or more of the projections can be passed through the aperture.

* * * * *

UNITED STATES PATENT AND TRADEMARK OFFICE

CERTIFICATE OF CORRECTION

PATENT NO. : 8,069,537 B2
APPLICATION NO. : 12/122001
DATED : December 6, 2011
INVENTOR(S) : Christopher M. Gallant It is certified that error appears in the above-identified patent and that said Letters Patent is hereby corrected as shown below:

Claim 18, column 12, line 38:
delete "hinge hinge" and replace with --hinge--.

Signed and Sealed this
Seventh Day of February, 2012

David J. Kappos

David J. Kappos
*Director of the United States Patent and Trademark Office*